US009566799B1

(12) United States Patent
Barkley et al.

(10) Patent No.: US 9,566,799 B1
(45) Date of Patent: Feb. 14, 2017

(54) IMAGING APPARATUS AND METHOD FOR REDUCING BANDING

(71) Applicant: FUNAI ELECTRIC CO., LTD., Osaka (JP)

(72) Inventors: Lucas D. Barkley, Lexington, KY (US); Stephen T. Olson, Lexington, KY (US)

(73) Assignee: FUNAI ELECTRIC CO., LTD. (JP)

( * ) Notice: Subject to any disclaimer, the term of this patent is extended or adjusted under 35 U.S.C. 154(b) by 0 days.

(21) Appl. No.: 14/882,947

(22) Filed: Oct. 14, 2015

(51) Int. Cl.

| | |
|---|---|
| ***B41J 2/21*** | (2006.01) |
| ***B41J 29/393*** | (2006.01) |
| ***B41J 19/14*** | (2006.01) |
| ***B41J 2/51*** | (2006.01) |
| ***B41J 25/00*** | (2006.01) |

(52) U.S. Cl.
CPC ..... *B41J 2/2132* (2013.01); *B41J 2/21* (2013.01); *B41J 2/51* (2013.01); *B41J 19/142* (2013.01); *B41J 19/147* (2013.01); *B41J 25/005* (2013.01); *B41J 29/393* (2013.01)

(58) Field of Classification Search
CPC ..... B41J 2/2132; B41J 25/005; B41J 2/51; B41J 19/147; B41J 19/142; B41J 29/393; B41J 2/21
See application file for complete search history.

(56) References Cited

U.S. PATENT DOCUMENTS

| | | | | |
|---|---|---|---|---|
| 5,448,269 | A | 9/1995 | Beauchamp et al. | |
| 6,089,766 | A | 7/2000 | Yamada et al. | |
| 6,310,637 | B1 * | 10/2001 | Shimada | B41J 19/145 15/37 |
| 6,435,643 | B1 | 8/2002 | Miura et al. | |
| 6,474,767 | B1 | 11/2002 | Teshigawara et al. | |
| 6,997,541 | B2 | 2/2006 | Edamura et al. | |
| 7,467,843 | B2 | 12/2008 | Olson | |
| 8,759,762 | B2 * | 6/2014 | Xiao | H01L 22/12 250/306 |
| 2004/0036731 | A1 * | 2/2004 | Ready | H01L 21/288 347/19 |
| 2011/0228027 | A1 * | 9/2011 | Okada | B41J 2/45 347/116 |

* cited by examiner

*Primary Examiner* — Justin Seo
(74) *Attorney, Agent, or Firm* — Aust IP Law

(57) ABSTRACT

A method for reducing horizontal banding in a printed image printed with an inkjet print engine includes printing on a print media sheet a first test patch with a first inkjet printhead being moved by the printhead carrier in a first print direction; printing on a print media sheet a second test patch with the first inkjet printhead being moved by the printhead carrier in a second print direction; determining a first characteristic of the first test patch; determining a second characteristic of the second test patch; comparing the first characteristic of the first test patch with the second characteristic of the second test patch; and selecting, based on the comparing, an initial print direction of the first inkjet printhead for a first printing pass that reduces horizontal banding in generating the printed image.

19 Claims, 9 Drawing Sheets

IMAGING APPARATUS AND METHOD FOR REDUCING BANDING

CROSS-REFERENCE TO RELATED APPLICATIONS

None.

BACKGROUND OF THE INVENTION

1. Field of the Invention

The present invention relates to reducing horizontal banding in inkjet printing, and, more particularly, to an imaging apparatus and method for reducing horizontal banding by determining an optimal print direction for an initial printing pass when generating a printed image with an inkjet printhead.

2. Description of the Related Art

An inkjet print engine of an inkjet printer or multifunction imaging device forms an image on a print media sheet by horizontally scanning one or more inkjet printheads across the print media sheet in multiple printing passes, also referred to as printing swaths, and by indexing the print media sheet in an orthogonal direction, e.g., a vertical direction, between printing passes. Such inkjet print engines are capable of printing in multiple printing modes, e.g., draft, high quality, photo, etc. It is generally recognized that reducing the number of passes of the printheads when printing on plain paper improves the printing throughput compared to the highest quality modes. Also having an effect on print quality is the undesirable generation of horizontal banding. Horizontal banding may include both dark bands and white bands at the boundary between print swaths, where ink drops at the edge of a swath are printed too close or too far from drops in the adjacent or overlapping print swath. Horizontal banding also may include color order differences in different passes, causing darkness and hue differences, as well as dry time differences, both of which may happen inside the print swaths, as well as at the edges.

A scanned banding metric print sample may be used to assess banding visible to the human eye. The banding sample will score differently depending on whether or not there is a mono barcode printed across the top of the sample. The difference the barcode makes is to change the print direction of the first color swath so that all the color swaths are reversed down the banding metric page. The print direction includes whether the color order is cyan-magenta-yellow or yellow-magenta-cyan.

Print quality may further be dependent upon how the ink dots are formed on the printed page. Manufacturing variations contribute to the tendency of both monochrome and color inkjet printheads to show dot quality differences as a function of carrier direction. Each ink drop generated by an inkjet printhead typically includes a mother (primary) drop and at least one satellite drop, wherein a satellite drop typically follows the mother drop. The satellite drop may land on the print medium inside, partially on, or outside the mother drop, and this phenomena is often referred to as satellite asymmetry. Satellite asymmetry is due to a difference in satellite direction with respect to the mother drop, and is very common in manufactured inkjet printheads. It is known that satellite asymmetry can cause graininess of a print recording. Graininess in an image will be aggravated by the presence of satellite dots. One approach, such as that disclosed in U.S. Pat. No. 7,467,843, is to determine the optimal direction of carrier travel in which a printhead exhibits the least tendency to generate unwanted satellites while recording an image to reduce image graininess.

SUMMARY OF THE INVENTION

In accordance with the present invention, it has been determined that the tendency of a printhead to generate satellites that have a landing location, i.e., an area, coincident with the mother ink drop in one print direction, and adjacent to the mother ink drop in the other print direction, may further be considered in choosing an initial print direction that reduces, e.g., minimizes, banding. As used herein, a satellite ink drop that is "coincident with the mother ink drop" means that the satellite ink drop is entirely within the circumference of the mother ink drop without the centers of the ink drops necessarily being exactly the same. Also, as used herein, a satellite ink drop that is "adjacent to the mother ink drop" means that at least a portion of the satellite ink drop is outside the circumference of the mother ink drop and includes where the satellite ink drop is entirely outside the circumference of the mother ink drop.

The invention, in one form, is directed to a method for reducing horizontal banding in a printed image printed with an inkjet print engine having a printhead carrier carrying at least one inkjet printhead. The method includes printing on a print media sheet a first test patch with a first inkjet printhead being moved by the printhead carrier in a first print direction; printing on a print media sheet a second test patch with the first inkjet printhead being moved by the printhead carrier in a second print direction, the second print direction being opposite to the first print direction; determining a first characteristic of the first test patch; determining a second characteristic of the second test patch; comparing the first characteristic of the first test patch with the second characteristic of the second test patch; and selecting, based on the comparing, an initial print direction of the first inkjet printhead for a first printing pass that reduces horizontal banding in generating the printed image.

The invention, in another form, is directed to a method for reducing horizontal banding in a printed image printed with an inkjet print engine having a printhead carrier carrying at least one color inkjet printhead and at least one monochrome inkjet printhead, wherein the printed image is generated from multiple interleaved printing passes of at least one color inkjet printhead and at least one monochrome inkjet printhead. The method includes printing on a print media sheet with each color inkjet printhead and each monochrome printhead a respective pair of test patches, wherein a first test patch is printed while moving the printhead carrier in a first print direction and a second test patch is printed while moving the printhead carrier in a second print direction, the second print direction being opposite to the first print direction; scanning each respective pair of test patches with a sensor to generate sensing data corresponding to the first test patch and the second test patch for each color inkjet printhead and each monochrome printhead; determining from the sensing data, for each color inkjet printhead and each monochrome printhead, which of the first test patch and the second test patch has the most satellite ink drops offset from mother drops and designating such as a respective target test patch; identifying, for each color inkjet printhead and each monochrome printhead, a printing direction used in generating the respective target test patch, the printing direction being one of the first print direction and the second print direction and being designated as a respective target print direction; if the respective target print direction of each color inkjet printhead and each monochrome printhead is not in the same direction, then applying a printing direction conflict resolution criteria to select a preferred printing direction to be applied to each color inkjet printhead and each monochrome printhead; and selecting the preferred printing direction as an initial print direction for a first printing pass in printing on a print media sheet so as to reduce horizontal banding in generating the printed image.

The invention, in another form, is directed to a method for reducing horizontal banding in a printed image printed with an inkjet print engine having a printhead carrier carrying a plurality of inkjet printheads. The method includes printing on a print media sheet a first set of test patches with a first color inkjet printhead, a second color inkjet printhead, a third color inkjet printhead and a monochrome inkjet printhead being moved by the printhead carrier in a first print direction, the first set of test patches including a first color patch of a first color, a first color patch of a second color, a first color patch of a third color, and a first monochrome patch respectively corresponding to the first color inkjet printhead, the second color inkjet printhead, the third color inkjet printhead and the monochrome inkjet printhead; printing on a print media sheet a second set of test patches with the first color inkjet printhead, the second color inkjet printhead, the third color inkjet printhead and the monochrome inkjet printhead being moved by the printhead carrier in a second print direction opposite the first print direction, the second set of test patches including a second color patch of the first color, a second color patch of the second color, a second color patch of the third color, and a second monochrome patch respectively corresponding to the first color inkjet printhead, the second color inkjet printhead, the third color inkjet printhead and the monochrome inkjet printhead; sensing a first color characteristic of the first color patch of the first color; sensing a second color characteristic of the first color patch of the second color; sensing a third color characteristic of the first color patch of the third color; sensing a first monochrome characteristic of the first monochrome patch; sensing a fourth color characteristic of the second color patch of the first color; sensing a fifth color characteristic of the second color patch of the second color; sensing a sixth color characteristic of the second color patch of the third color; sensing a second monochrome characteristic of the second monochrome patch; comparing the first color characteristic with the fourth color characteristic to determine which of first color patch of the first color and the second color patch of the first color is darker and designating such as a first color darkness value; comparing the second color characteristic with the fifth color characteristic to determine which of first color patch of the second color and the second color patch of the second color is darker and designating such as a second color darkness value; comparing the third color characteristic with the sixth color characteristic to determine which of first color patch of the third color and the second color patch of the third color is darker and designating such as a third color darkness value; comparing the first monochrome characteristic with the second monochrome characteristic to determine which of the first monochrome patch and the second monochrome patch is darker and designating such as a monochrome darkness value; and selecting, based on the comparing, an initial print direction of at least one of the first color inkjet printhead, the second color inkjet printhead, the third color inkjet printhead and the monochrome inkjet printhead for a first print pass so as to reduce horizontal banding in generating a printed image.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate at least one embodiment of the invention, and such exemplifications are not to be construed as limiting the scope of the invention in any manner.

DETAILED DESCRIPTION OF THE INVENTION

Figure 1:
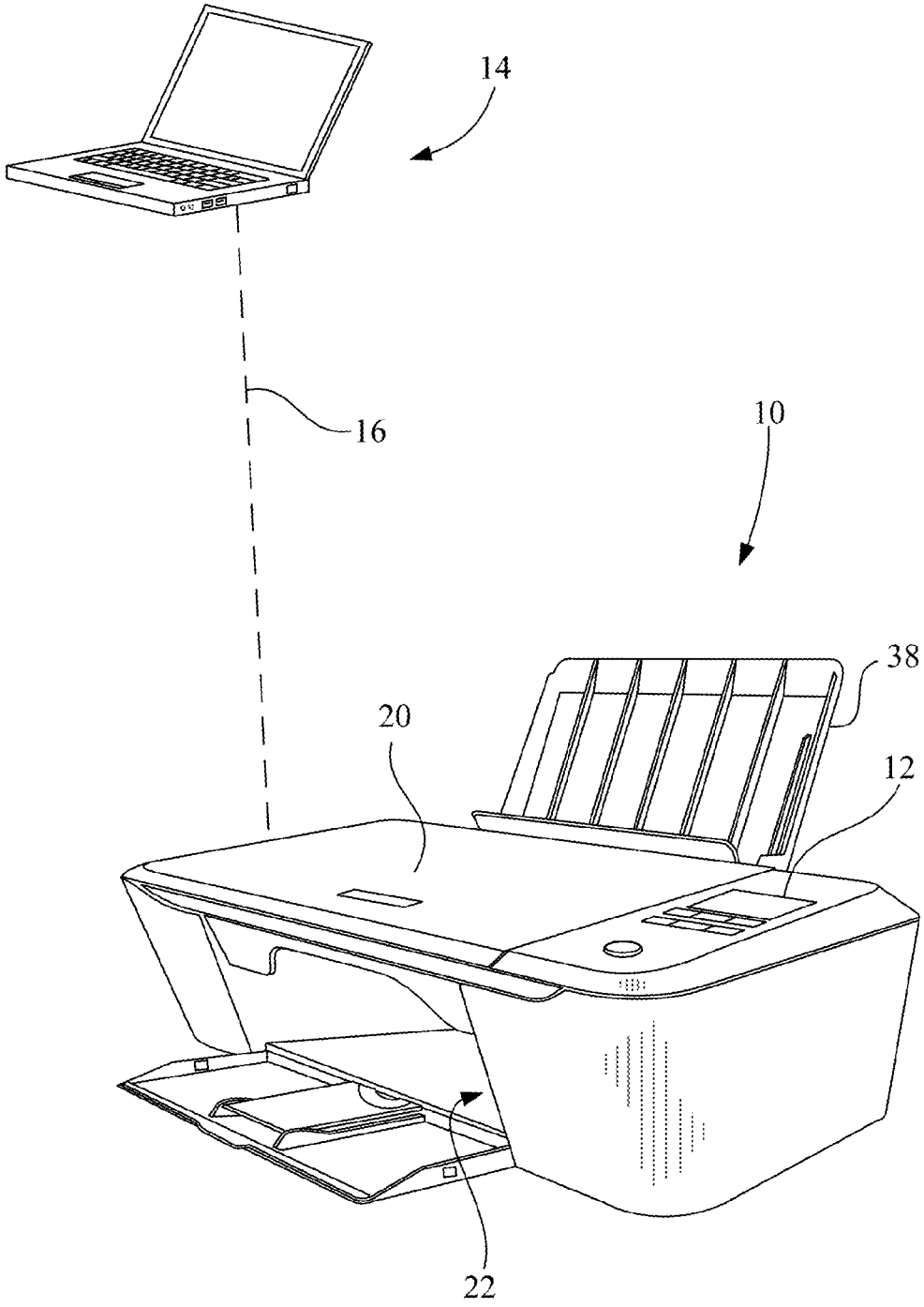
FIG. 1 is a perspective view of an imaging system that includes an imaging apparatus configured in accordance with the present invention.

Referring now to the drawings, and more particularly to FIG. 1, there is shown a multifunction imaging apparatus 10, which includes scanning, copying, inkjet printing and faxing functionality. Imaging apparatus 10 includes a user interface 12, and may be operated as a standalone device. User interface 12 may be, for example, a touch screen display having a touch surface to facilitate user input, and a display to provide visual information to the user.

Alternatively, imaging apparatus 10 may be communicatively coupled to a host device 14, such as a personal computer, tablet, cell phone, or other such electronic data processing device. Communications between imaging apparatus 10 and host device 14 may be facilitated by a communications link 16. Communications link 16 may be in the form of a wireless connection, such as Bluetooth or IEEE 802.11, or a wired connection, such as USB or Ethernet. Imaging apparatus 10 is interfaced with host device 14 via communications link 16 in order to transmit and/or receive data for use in carrying out printing, scanning, and faxing functions associated with imaging apparatus 10.

Figure 2:
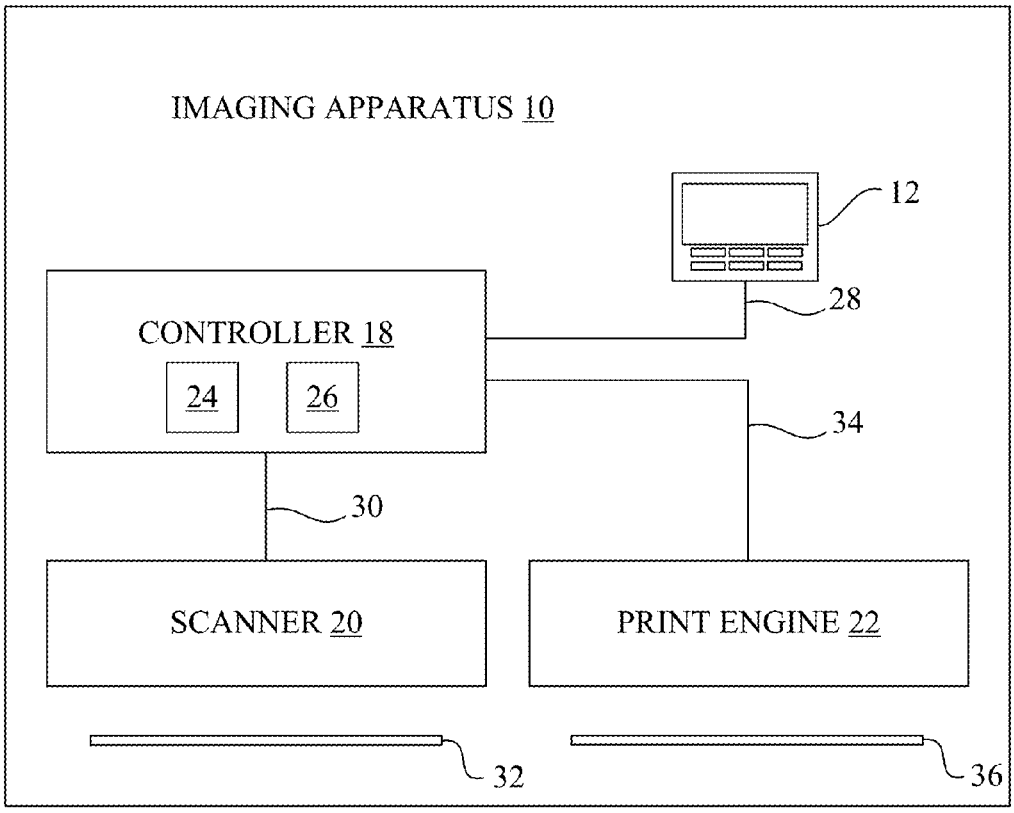
FIG. 2 is a block diagram depicting the major components of the imaging apparatus of FIG. 1.

Referring now also to FIG. 2, there is shown a diagrammatic depiction of imaging apparatus 10. In the present embodiment, imaging apparatus 10 includes a controller 18, a scanner 20, and print engine 22.

Controller 18 includes a processor circuit 24 and a memory circuit 26, and may be formed as one or more Application Specific Integrated Circuits (ASIC). Processor circuit 24 of controller 18 may be configured via software and/or firmware to operate as a printer controller and/or a scanner controller for performing printing and scanning functions. Although controller 18 is depicted as residing in imaging apparatus 10, in embodiments that include host device 14, a portion of controller 18 may reside in host device 14.

Controller 18, and more particularly processor circuit 24, is communicatively coupled to user interface 12 via communications link 28, e.g., by wired connections. Processor circuit 24 has one or more programmable microprocessors and associated circuitry, such as an input/output interface, clock, buffers, memory, etc. Memory circuit 26 is communicatively coupled to processor circuit 24, e.g., via a bus circuit, and may include volatile memory circuits, such as random access memory (RAM), and non-volatile memory circuits, such as read only memory (ROM), electronically erasable programmable ROM (EEPROM), NOR flash memory, NAND flash memory, etc.

Controller 18 is electrically connected and communicatively coupled to scanner 20 via a communications link 30. Controller 18 executes program instructions to operate scanner 20 during a scanning operation, such as electronic scanning, copying or faxing operations, to convert a printed image formed on a print media substrate 32, such as a sheet of paper, into digital data representative of the printed image. Scanner 20 may be, for example, a flatbed scanner. Scanner 20 may be a color scanner having three data channels, e.g., RGB (red, green, blue), the operation of which is well known in the art.

Controller 18 is electrically connected and communicatively coupled to print engine 22 via a communications link 34, such as for example, one or more multi-conductor interface cables. Controller 18 executes program instructions to process print commands, to process print data (e.g., by performing data formatting, half-toning, etc.), and to operate print engine 22 during a printing operation, to form a printed image on a print media sheet 36. Print media sheet 36 may be, for example, plain paper, coated paper, photo paper and transparency media. It is to be understood that the printing operation may also include the printing aspects of a copying operation.

Figure 3:
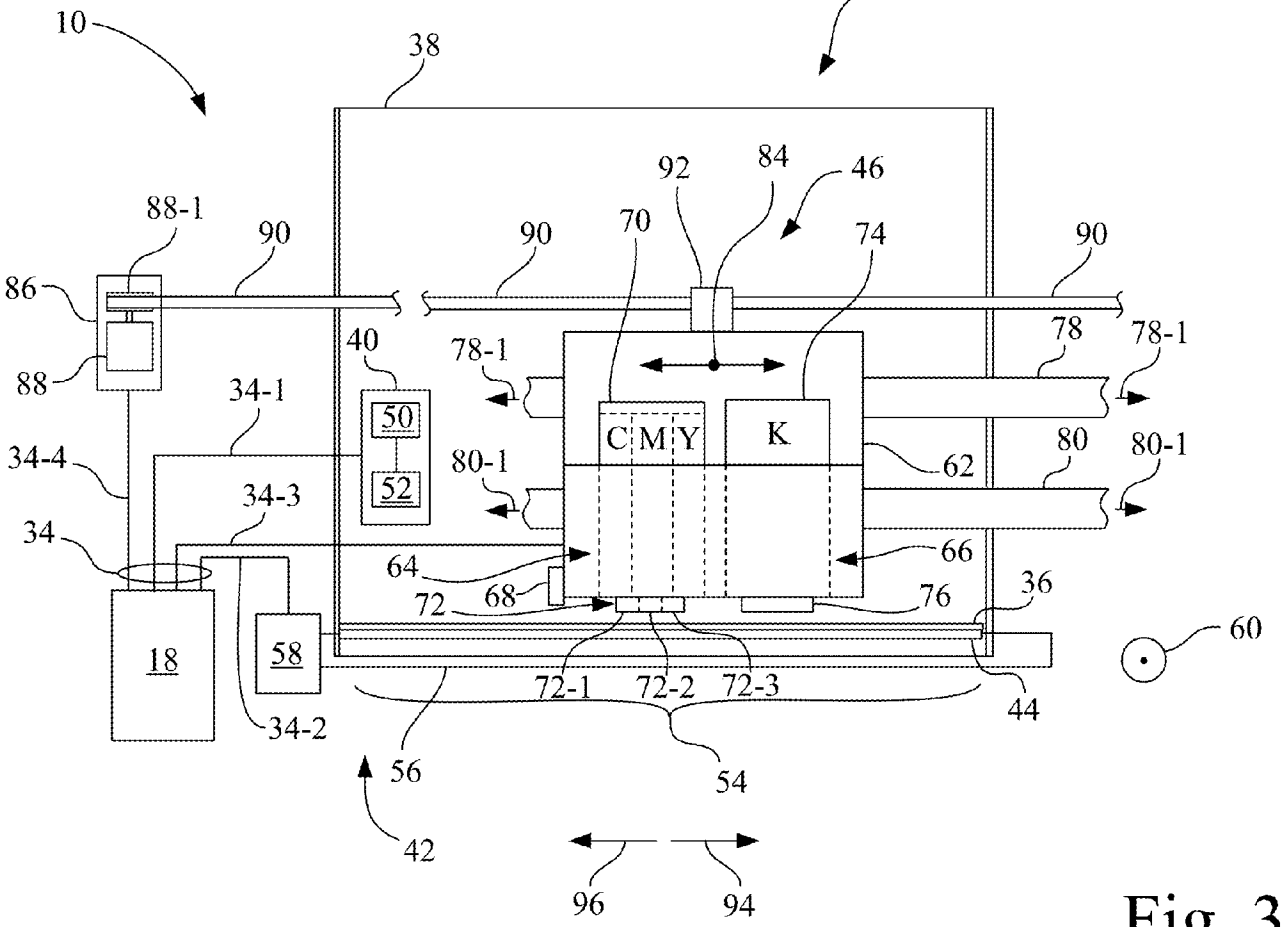
FIG. 3 is a depiction of the inkjet print engine of the imaging apparatus of FIG. 2.

In the present embodiment, print engine 22 is an inkjet print engine. Referring also to FIG. 3, inkjet print engine 22 includes a media source 38, a sheet picking unit 40, a feed roller unit 42, a sheet support mid-frame 44, and a printhead carrier system 46. Controller 18 is electrically connected and communicatively coupled to each of sheet picking unit 40, feed roller unit 42, and printhead carrier system 46 via communications link 34.

Media source 38 is configured, e.g., as a vertically oriented tray, to receive a plurality of print media sheets from which a print medium, e.g., a print media sheet 36, is picked by sheet picking unit 40. Sheet picking unit 40 includes a motor 50 rotatably coupled to a pick roller 52, and motor 50 is communicatively coupled to controller 18 via an interface cable 34-1 of communications link 34. Interface cable 34-1 may be, for example, a multiple-wire electrical conductor. Pick roller 52 rotatably engages print media sheet 36, and in turn transports print media sheet 36 to feed roller unit 42, which in turn further transports print media sheet 36 during a printing operation to mid-frame 44.

Mid-frame 44 provides support for the print media sheet 36 when the print media sheet 36 is in a print zone 54, wherein print zone 54 defines, in part, a portion of a print media path of print engine 22.

Feed roller unit 42 includes a feed roller 56 and corresponding index pinch rollers (not shown). Feed roller 56 is rotatably driven by a drive unit 58. Controller 18 is electrically connected and communicatively coupled to drive unit 58 via an interface cable 34-2 of communications link 34. Interface cable 34-2 may be, for example, a multiple-wire electrical conductor. The index pinch rollers apply a biasing force to hold the print media sheet 36 in contact with respective driven feed roller 56. Drive unit 58 includes a drive source, such as a stepper motor, associated interface circuitry, and an associated drive mechanism, such as a gear train or belt/pulley arrangement. Feed roller unit 42 feeds the print media sheet 36 over mid-frame 44 in a sheet feed direction 60, designated as a dot in a circle to indicate that the sheet feed direction is out of the plane of FIG. 3, and over mid-frame 44. Sheet feed direction 60 is commonly referred to as the vertical direction.

Printhead carrier system 46 includes a printhead carrier 62 for mounting and carrying a tri-color inkjet cartridge 64 and a monochrome inkjet cartridge 66. Also mounted to printhead carrier 62 is an optical sensor 68.

Tri-color inkjet cartridge 64 includes a tri-chambered color ink reservoir 70 provided in fluid communication with a tri-color inkjet printhead 72 having three nozzle arrays and associated firing heaters, each of which being associated with a respective ink color for jetting ink drops of the respective color. Thus, tri-color inkjet printhead 72 may be considered to be a combination of three printheads, namely, inkjet printhead 72-1, inkjet printhead 72-2, and inkjet printhead 72-3. In the present embodiment, the tri-chambered color ink reservoir 70 has three individual reservoirs, with each including one of three ink colors, such as cyan (C), magenta (M), and yellow (Y). Those skilled in the art will recognize that the tri-color inkjet cartridge 64 may alternatively be in the form of three individual discrete cartridges, one cartridge for each of C, M, and Y.

Monochrome inkjet cartridge 66 includes a monochrome ink reservoir 74 in fluid communication with a monochrome inkjet printhead 76. In the present embodiment, monochrome ink reservoir 74 contains a black (K) ink, and monochrome ink reservoir 74 is provided in fluid communication with monochrome inkjet printhead 76, e.g., having a black ink nozzle plate and associated firing heaters, for jetting drops of black ink.

Controller 18 is electrically connected and communicatively coupled to tri-color inkjet printhead 72 and monochrome inkjet printhead 76, and optical sensor 68, via an interface cable 34-3 of communications link 34. Interface cable 34-3 may be, for example, a multiple-wire electrical conductor.

In the embodiment shown in FIG. 3, printhead carrier system 46 further includes a pair of guide members 78, 80, such as guide rods, for guiding printhead carrier 62. Each of guide members 78, 80 includes a respective horizontal axis 78-1, 80-1. Printhead carrier 62 may include guide rod bearings and/or guide surfaces (not shown) for receiving guide members 78, 80. Thus, guide members 78, 80, and in turn horizontal axes 78-1, 80-1, define a bi-directional scanning path 84 for printhead carrier 62. Accordingly, bi-directional scanning path 84 is associated with each of tri-color inkjet printhead 72 (72-1, 72-2, 72-3) of tri-color inkjet cartridge 64, monochrome inkjet printhead 76 of monochrome inkjet cartridge 66, and optical sensor 68.

Printhead carrier system 46 further includes carrier drive 86 that includes a carrier motor 88, a carrier transport belt 90, and a carrier drive attachment device 92. Carrier motor 88 may be, for example, a direct current (DC) motor or a stepper motor. Controller 18 is electrically connected and communicatively coupled to carrier motor 88 via an interface cable 34-4 of communications link 34. Interface cable 34-4 may be, for example, a multiple-wire electrical conductor. Printhead carrier 62 is connected to carrier transport belt 90 via carrier drive attachment device 92. Carrier transport belt 90 is driven by a carrier motor 88 via a carrier pulley 88-1. At the directive of controller 18, printhead carrier 62 is transported in a reciprocating manner along guide members 78, 80, i.e., along bi-directional scanning path 84.

The reciprocation of printhead carrier 62 transports tri-color inkjet printhead 72 and monochrome inkjet printhead 76 across the print media sheet 36 along bi-directional scanning path 84 to define the print zone 54 of print engine 22. The reciprocation of printhead carrier 62 occurs along bi-directional scanning path 84, and is also commonly referred to as the horizontal direction.

The horizontal bi-directional scanning path 84 includes a left-to-right print direction 94 and a right-to-left print direction 96. Thus, sheet feed direction 60 is perpendicular to the horizontal bi-directional scanning path 84, and in turn, is perpendicular to the horizontal print directions 94, 96. Thus, with respect to print media sheet 36, carrier reciprocation occurs in a horizontal direction and media advance occurs in a vertical direction, and the carrier reciprocation is perpendicular to the media advance. Typically, during each horizontal pass of printhead carrier 62 in one of horizontal print directions 94, 96 while printing, the print media sheet 36 is held stationary by feed roller unit 42.

During a printing operation, controller 18 executes program instructions to control the reciprocation of printhead carrier 62 in the horizontal print directions 94, 96, to control the operations (e.g., firing) of tri-color inkjet printhead 72 (72-1, 72-2, 72-3) and monochrome inkjet printhead 76, and to select an index feed distance of print media sheet 36 along the print media path as conveyed by feed roller 56 in the vertical direction 60.

Also, optical sensor 68 may be controlled to horizontally scan across print media sheet 36 in the horizontal directions 94, 96 by controlling the reciprocation of printhead carrier 62. Optical sensor 68 may be monitored by controller 18 to collect sensing data generated by optical sensor 68 relating to a sensed characteristic of an image printed on print media sheet 36.

In the present embodiment, for example, optical sensor 68 may be in the form of a reflectance sensor, such as that typically used in achieving printhead alignment, as is known in the art. The optical sensor 68 may be, for example, a unitary optical sensor including at least one light source, such as a light emitting diode (LED) emitting white light, and at least one reflectance detector, such as a phototransistor. The reflectance detector is located on the same side of the print media sheet as the light source. In some applications, optical sensor 68 may have a single output channel. However, a preferred optical sensor 68 is a three channel device having RGB (red, green, blue) output channels. The operation of such optical sensors is well known in the art, and thus, will be discussed herein to the extent necessary to relate the operation of optical sensor 68 to the operation of the present invention.

In general, the LED of optical sensor 68 directs light at a predefined angle onto a surface to be read, such as the surface of the print media sheet, and at least a portion of light reflected from the surface is received by the reflectance detector of the reflectance sensor. The intensity of the reflected light received by optical sensor 68 varies with the reflectance, i.e. reflectivity, of the surface. Thus, as used herein, the term "reflectance" refers to the intensity of the light reflected from the sheet of print media scanned by optical sensor 68.

Alternatively, the reflected light may be processed, such as by using a CIELAB tri-color (L*, a*, b*) color space converter, in terms of chromatic characteristics and/or luminance characteristics of a printed image. The CIELAB tri-color, L*, a*, and b* values may be utilized in some embodiments of the present invention, where L* values refer to luminance values (lightness axis, wherein (L*=0 yields black and L*=100 indicates white), a* values refer to red-green chrominance values (redness-greenness axis), and b* refers to blue-yellow chrominance values (yellowness-blueness axis).

The light received by the optical sensor 68 is converted to an electrical signal and is supplied to controller 18 as sensing data for further processing.

In accordance with the present invention, it has been determined that consideration of the tendency of a printhead to generate a satellite drop that has a landing location coincident with the mother drop in one print direction, and adjacent to the mother drop in the other print direction, is beneficial in choosing an initial print direction that reduces horizontal banding in forming the printed image. The follow describes methods for determining an initial print direction that reduces horizontal banding in forming a printed image, and are described in the context of imaging apparatus 10 and inkjet print engine 22, described above.

Figure 4:
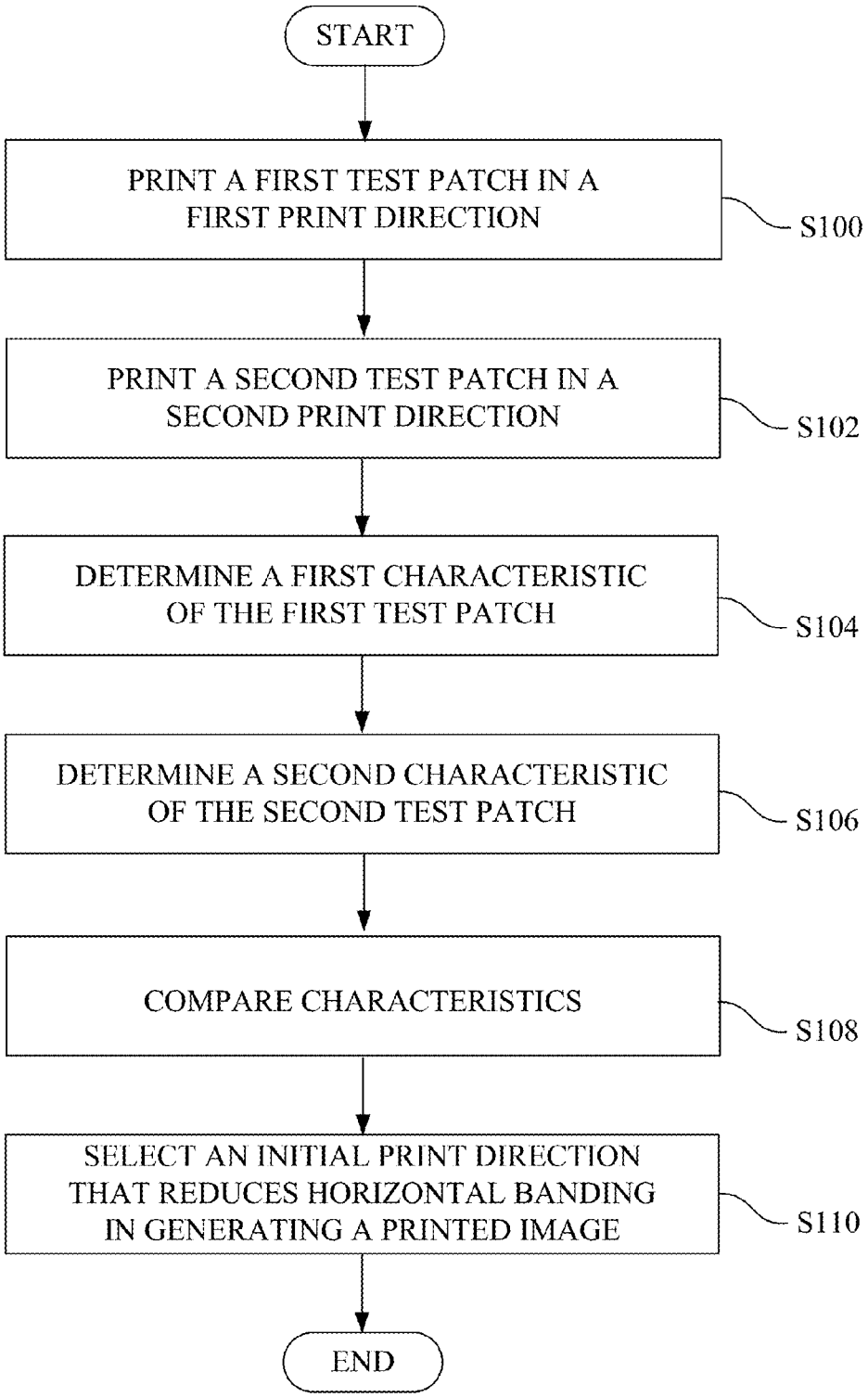
FIG. 4 is a flowchart directed to a method for reducing horizontal banding in a printed image printed with the inkjet print engine of FIGS. 1-3.

In particular, FIG. 4 is directed to a method for reducing horizontal banding in a printed image printed with inkjet print engine 22, in which printhead carrier 62 carries at least one inkjet printhead, e.g., one of inkjet printheads 72-1, 72-2, 72-3 and 76. Those skilled in the art will recognize that the method may be applied to any of inkjet printheads 72-1, 72-2, 72-3 and 76. The method of FIG. 4 may be implemented, in whole or in part, in the form of program instructions executed by controller 18.

Figure 5:
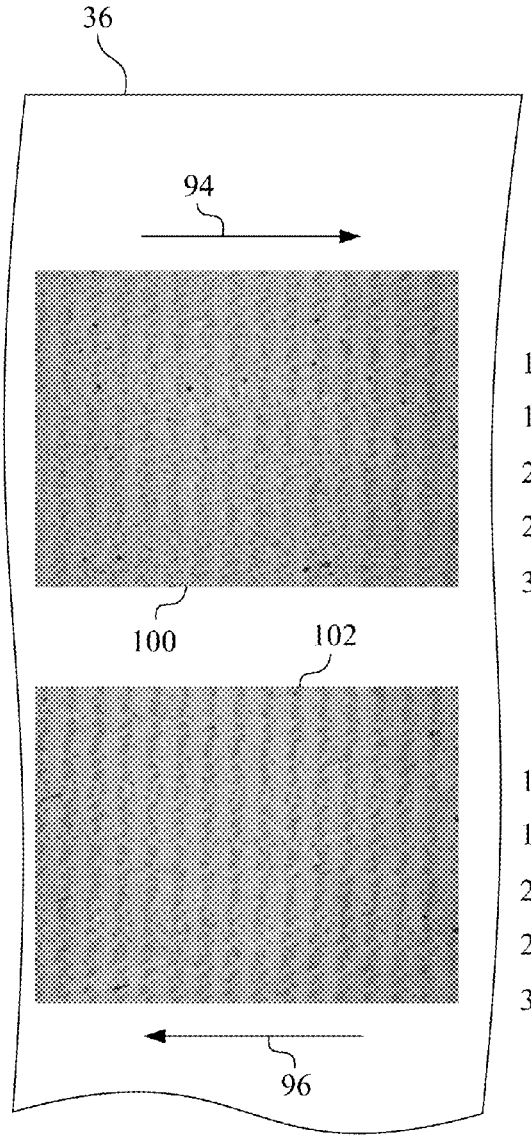
FIG. 5 is a pictorial depiction of two test patches printed with the same inkjet printhead, but in opposite directions.

At step S100, with reference also to FIG. 5, a first test patch 100 is printed on a print media sheet, such as print media sheet 36, with an inkjet printhead, i.e., one of inkjet printheads 72-1, 72-2, 72-3 and 76, being moved by the printhead carrier 62 in a left-to-right print direction 94.

The first test patch 100, printed in left-to-right print direction 94, is populated by the inkjet printhead at a horizontal resolution (e.g., 300 dots per inch) and a vertical resolution (e.g., 1200 dots per inch) defining a plurality of ink dot locations. The inkjet printhead is controlled by controller 18 to deliver an ink drop at each of the plurality of ink dot locations. As is known in the art, in inkjet printing, the ink drop includes a mother ink drop and at least one satellite ink drop.

At step S102, a second test patch 102 is printed on print media sheet 36, with the inkjet printhead being moved by the printhead carrier 62 in a right-to-left print direction 96. The right-to-left print direction 96 is an opposite horizontal direction from that of the left-to-right print direction 94.

The second test patch 102, printed in right-to-left print direction 96, is populated by the same inkjet printhead as used in printing first test patch 100, at a horizontal resolution and a vertical resolution defining a plurality of ink dot locations. The inkjet printhead is controlled by controller 18 to deliver an ink drop at each of the plurality of ink dot locations. Again, the ink drop includes a mother ink drop and at least one satellite ink drop.

At step S104, a characteristic of the first test patch 100 is determined. In the present embodiment, the characteristic of the first test patch 100 is one of a reflectance characteristic, a luminance characteristic, and a chromatic characteristic.

At step S106, a characteristic of the second test patch 102 is determined. In the present embodiment, the characteristic of the second test patch 102 is one of a reflectance characteristic, a luminance characteristic, and a chromatic characteristic. To be clear, the same type of characteristic will be determined for both of first test patch 100 and second test patch 102.

An optical sensor 68, such as a multi-channel optical sensor in the present embodiment, may be used to sense the characteristics of first test patch 100 and second test patch 102. The multi-channel optical sensor 68 has at least one light emitter having red, green and blue light components and has a tri-color detector, such as red, green, and blue light detectors. Alternatively, first test patch 100 and the second test patch 102 may be scanned by the flatbed scanner 20 of imaging apparatus 10 to acquire the characteristic of first test patch 100 and second test patch 102.

Assume, for this example, that the inkjet printhead is a color inkjet printhead, i.e., one of color inkjet printheads 72-1, 72-2, 72-3, for respectively printing a color ink that is one of cyan, magenta, and yellow. The multi-channel optical sensor 68 has a red light channel, which is used to generate sensing data for a cyan test patch; has a green light channel, which is used to generate sensing data for a magenta test patch; and has a blue light channel, which is used to generate sensing data for a yellow test patch. The respective sensing data is supplied to controller 18 for further processing.

Figure 6:
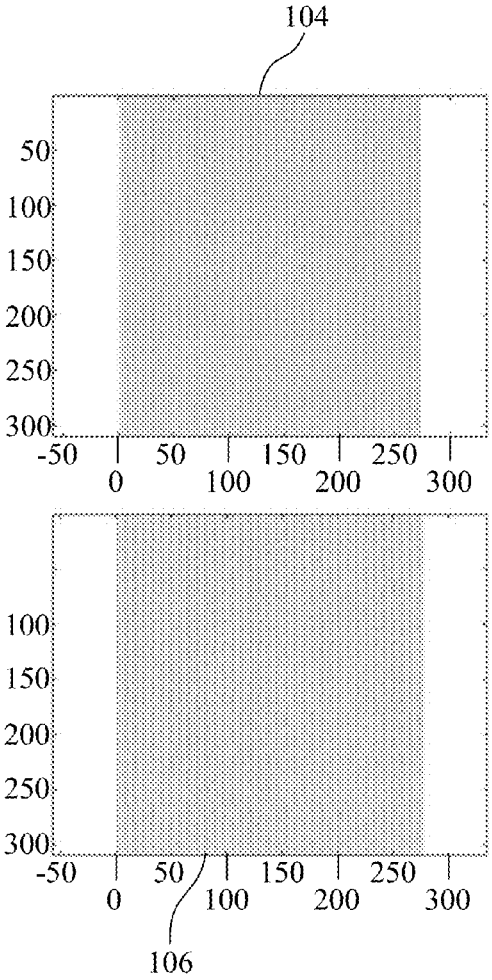
FIG. 6 is a graphical depiction of sensing data representative of the two test patches of FIG. 5.

FIG. 6 is a graphical depiction of sensing data 104 associated with first test patch 100 and a graphical depiction of sensing data 106 associated with second test patch 102. In this example, each of first test patch 100 and second test patch 102 have been printed, in opposite directions, using cyan ink. First test patch 100 has less overlap between the mother ink drop and the satellite ink drop than that of second test patch 102, and thus first test patch 100 will be sensed as being darker than second test patch 102. For example, on a red channel sensing scale, wherein 0 is the darkest value (100 percent cyan, in this example) and 255 is the lightest value (0 percent cyan, e.g., white), the sensing data 104 associated with first test patch 100 may have a red channel value of 167, whereas the sensing data 106 associated with second test patch 102 may have a red channel value of 175.

At step S108, the characteristic of the first test patch 100 is compared with the characteristic of the second test patch 102. Controller 18 executes program instructions to make the comparison. In accordance with the example of step S106, the sensing data associated with first test patch 100 and second test patch 102 is compared. Referring again to FIG. 6, and the example above, the sensing data 104 associated with first test patch 100 has a red channel value of 167, whereas the sensing data 106 associated with second test patch 102 has a red channel value of 175, thus indicating that first test patch 100 is the darker of the two patches. Based on the comparison of the sensing data 104 and sensing data 106, since sensing data 104 has the lesser red channel value, and since sensing data 104 is associated with first test patch 100 which was printed in left-to-right print direction 94, then it is concluded that left-to-right print direction 94 produces the least amount of overlap between the mother ink drop and the satellite ink drop, with respect to cyan inkjet printhead 72-1 in this example.

At step S110, an initial print direction of the inkjet printhead for a first printing pass is selected, based on the comparing at step S108, which reduces horizontal banding produced by adjacent or overlapping print swaths printed during multiple printing passes by the inkjet printhead in generating a printed image. Controller 18 executes program instructions to make the selection. This selection selects as the initial print direction the one print direction of the left-to-right print direction 94 and the right-to-left print direction 96 that produces the least amount of overlap between the mother ink drop and the satellite ink drop. In the example of FIGS. 5 and 6, left-to-right print direction 94 produces the least amount of overlap between the mother ink drop and the satellite ink drop, and thus left-to-right print direction 94 is selected as the initial print direction of the inkjet printhead for a first printing pass in a multi-pass printing to generate a printed image on a print media sheet.

In the method of FIG. 4 described above, each of the characteristic of first test patch 100 and the characteristic of second test patch 102 is reflectance within a particular color channel. If the first reflectance of first test patch 100 is less than the second reflectance of second test patch 102, then the left-to-right print direction 94 is selected as the initial print direction. Conversely, if the second reflectance of second test patch 102 is less than the first reflectance of first test patch 100, then the right-to-left print direction 96 of second test patch 102 is selected as the initial print direction.

In a variation of the embodiment using the method of FIG. 4, the inkjet printhead is assumed to be black inkjet printhead 76, each of the first test patch 100 and second test patch 102 is formed by black ink, and each of the characteristic of first test patch 100 and the characteristic of second test patch 102 is luminance. If the first luminance L* value of first test patch 100 is less than the second luminance L* value of second test patch 102, then the left-to-right print direction 94 is selected as the initial print direction. Conversely, if the second luminance L* value of second test patch 102 is less than the first luminance L* value of first test patch 100, then the right-to-left print direction 96 is selected as the initial print direction.

In another variation of the embodiment using the method of FIG. 4, the inkjet printhead may be one of the color inkjet printheads, such as cyan inkjet printhead 72-1, each of the first test patch 100 and the second test patch 102 is formed by that color ink, e.g., cyan, and each of the characteristic of first test patch 100 and the characteristic of second test patch 102 is a chromatic value. If the first chromatic value of first test patch 100 is greater than the second chromatic value of second test patch 102, then the left-to-right print direction 94 is selected as the initial print direction. Conversely, if the second chromatic value of second test patch 102 is greater than the first chromatic value of first test patch 100, then the right-to-left print direction 96 is selected as the initial print direction.

Controller 18 executes program instructions to select the initial print direction for a first printing pass, based on the comparing, that reduces horizontal banding produced by adjacent or overlapping print swaths printed during multiple printing passes printed in generating a printed image, and the initial print direction may be stored in memory circuit 26 for future use by inkjet print engine 22 during printing operations.

Figure 7A:
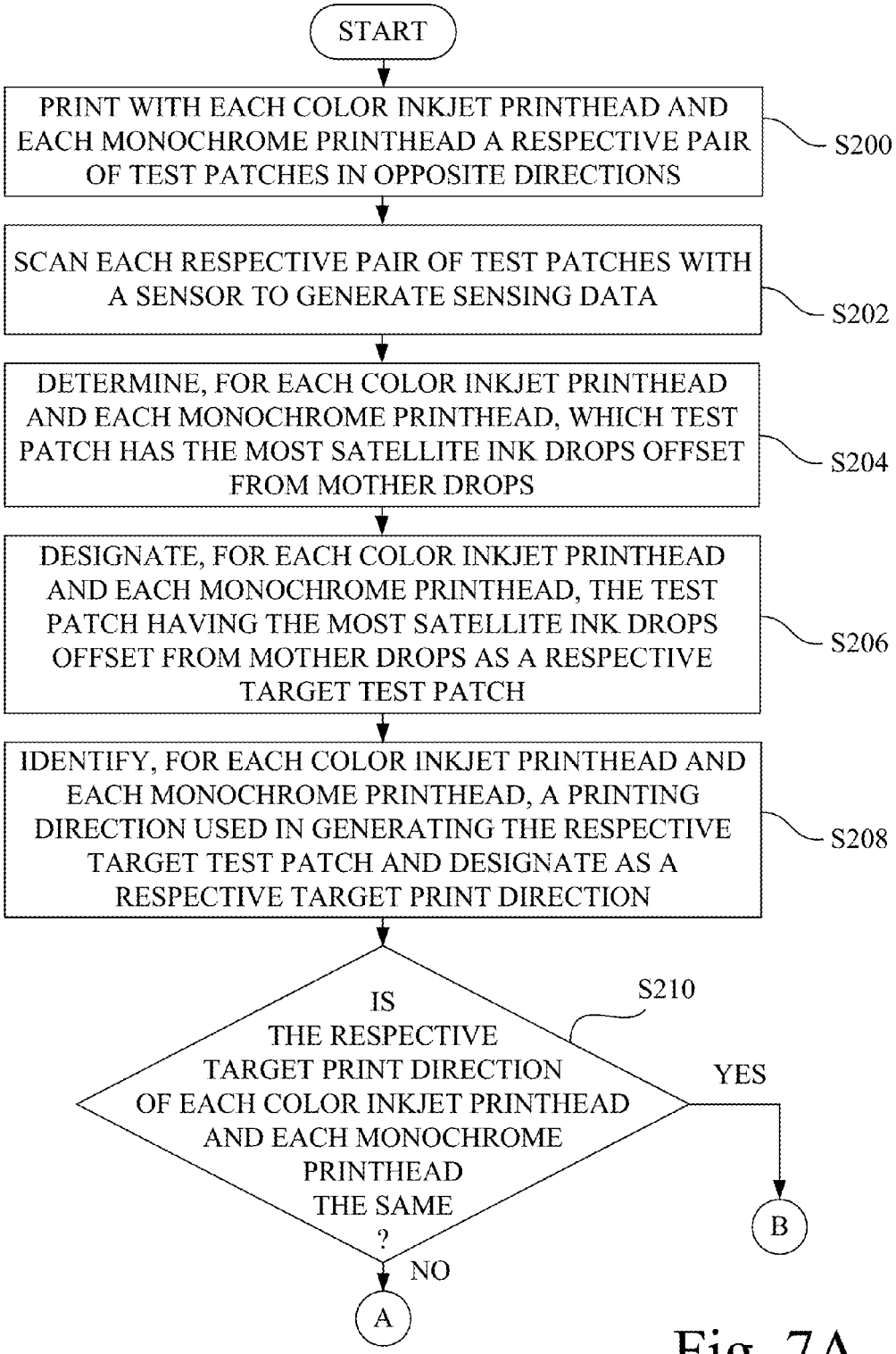
FIGS. 7A and 7B form a flowchart of another method for reducing horizontal banding in a printed image printed with the inkjet print engine of FIGS. 1-3.
Figure 7B:
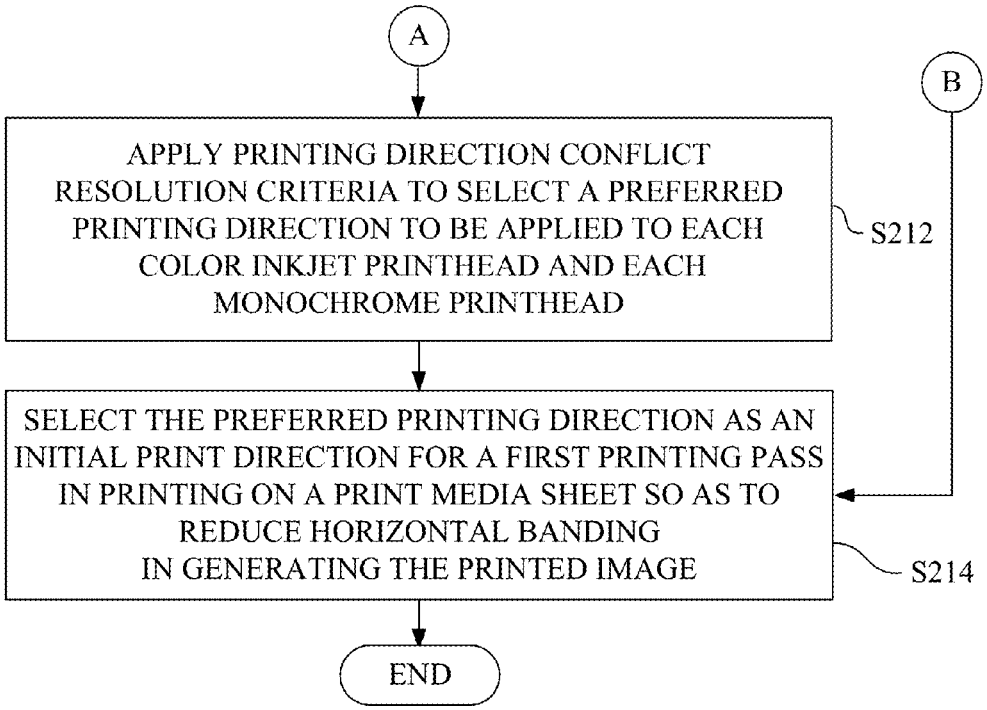

FIGS. 7A and 7B are directed to another method for reducing horizontal banding in a printed image printed with an inkjet print engine 22, wherein the printed image is generated from multiple interleaved printing passes of the inkjet printheads 72-1, 72-2, 72-3 and 76. The method of FIGS. 7A, 7B may be implemented, in whole or in part, in the form of program instructions executed by controller 18.

Figure 8:
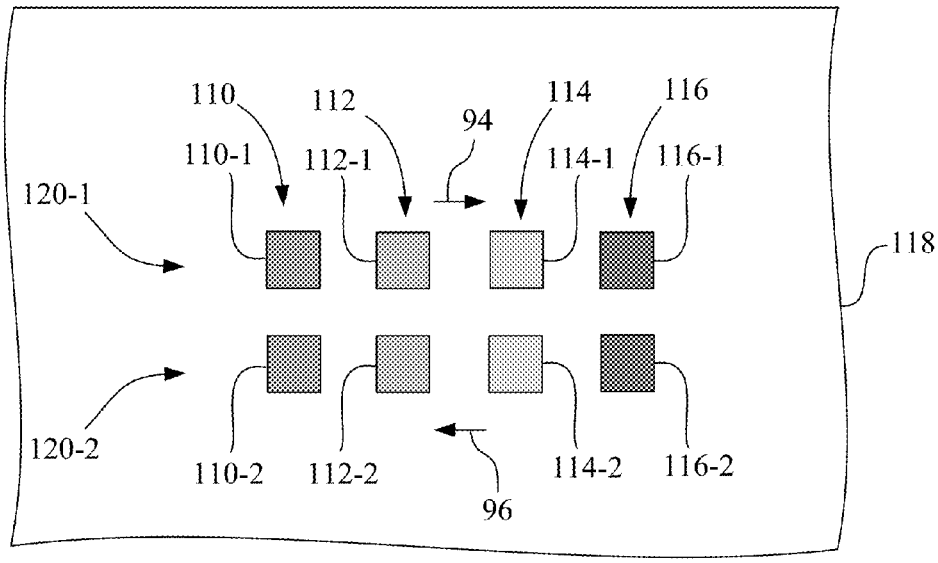
FIG. 8 is a pictorial depiction of eight test patches, with the upper set of four test patches printed by the C, M, Y, and K inkjet printheads, respectively, in a left-to-right print direction, and the lower set of four test patches printed by the C, M, Y, and K inkjet printheads, respectively, in a right-to-left print direction.

At step S200, referring also to FIG. 8, with each color inkjet printhead 72-1, 72-2, 72-3 and monochrome inkjet printhead 76, a respective pair of test patches 110, 112, 114, 116 is printed on a print media sheet 118. The pair of test patches 110 includes a first test patch 110-1 printed while moving the printhead carrier 62 in a left-to-right print direction 94 and a second test patch 110-2 printed while moving the printhead carrier 62 in a right-to-left print direction 96. Likewise, the pair of test patches 112 includes a first test patch 112-1 printed while moving the printhead carrier 62 in a left-to-right print direction 94 and a second test patch 112-2 printed while moving the printhead carrier 62 in a right-to-left print direction 96. Likewise, the pair of test patches 114 includes a first test patch 114-1 printed while moving the printhead carrier 62 in a left-to-right print direction 94 and a second test patch 114-2 printed while moving the printhead carrier 62 in a right-to-left print direction 96. Likewise, the pair of test patches 116 includes a first test patch 116-1 printed while moving the printhead carrier 62 in a left-to-right print direction 94 and a second test patch 116-2 printed while moving the printhead carrier 62 in a right-to-left print direction 96.

At step S202, each respective pair of test patches 110, 112, 114, 116 is scanned with a sensor, such as optical sensor 68 or scanner 20, to generate sensing data corresponding to each of the first test patches 110-1, 112-1, 114-1 and the second test patches 110-2, 112-2, 114-2, for each color inkjet printhead 72-1, 72-2, 72-3, and to generate sensing data corresponding to the first test patch 116-1 and the second test patch 116-2 for monochrome inkjet printhead 76.

As discussed above with respect to the method of FIG. 4, the sensing data is generated by a multi-channel optical sensor, e.g., optical sensor 68, having at least one light emitter having red, green and blue light components (e.g., a white light LED or individual red, green, and blue LEDs) and having red, green, and blue light detectors. The multi-channel optical sensor has a red light channel used to generate the sensing data for cyan test patches 110-1, 110-2; a green light channel used to generate the sensing data for magenta test patches 112-1, 112-2; and, a blue light channel used to generate the sensing data for yellow test patches 114-1, 114-2. The respective sensing data is supplied to controller 18 for further processing.

At step S204, it is determined from the sensing data, for each color inkjet printhead 72-1, 72-2, 72-3 and monochrome inkjet printhead 76, which of the first test patch and the second test patch has the most satellite ink drops offset from mother drops. Controller 18 executes program instructions to make the determination. For example, the sensing data for first test patch 110-1 is compared with the sensing data for second test patch 110-2 for cyan inkjet printhead 72-1; the sensing data for first test patch 112-1 is compared with the sensing data for second test patch 112-2 for magenta inkjet printhead 72-2; the sensing data for first test patch 114-1 is compared with the sensing data for second test patch 114-2 for yellow inkjet printhead 72-3; and, the sensing data for first test patch 116-1 is compared with the sensing data for second test patch 116-2 for black inkjet printhead 76.

At step S206, based on the determination at step S204, for each respective pair of test patches 110, 112, 114, 116 for color inkjet printhead 72-1, 72-2, 72-3 and monochrome inkjet printhead 76, respectively, the test patch from the respective pair that has the most satellite ink drops offset from mother drops is designated as a respective target test patch for that respective pair of test patches. Controller 18 executes program instructions to make the designation.

At step S208, for each color inkjet printhead 72-1, 72-2, 72-3 and monochrome inkjet printhead 76, a printing direction used in generating the respective target test patch is identified, and is designated as a respective target print direction. Controller 18 executes program instructions to make the designation.

At step S210, it is determined whether the respective target print direction of each color inkjet printhead 72-1, 72-2, 72-3 and monochrome inkjet printhead 76 is the same direction. Controller 18 executes program instructions to make the determination.

If the result of the determination at step S210 is YES, i.e., the respective target print direction of each color inkjet printhead 72-1, 72-2, 72-3 and monochrome inkjet printhead 76 is in the same direction, then the common target print direction is designated as the preferred printing direction. Then, the method proceeds to step S214.

However, if the result of the determination at step S210 is NO, i.e., the respective target print direction of each color inkjet printhead 72-1, 72-2, 72-3 and monochrome inkjet printhead 76 is not in the same direction, then the method proceeds to step S212.

At step S212, printing direction conflict resolution criteria is applied to select a preferred printing direction to be applied to each color inkjet printhead 72-1, 72-2, 72-3 and monochrome inkjet printhead 76. The printing direction conflict resolution criteria is in the form of program instructions executed by controller 18.

In one embodiment, for example, the printing direction conflict resolution criteria compares each respective target test patch associated with each color inkjet printhead 72-1, 72-2, 72-3 and monochrome inkjet printhead 76 to determine which respective target test patch has the most satellite ink drops offset from mother drops, so to select the corresponding respective target print direction as the preferred printing direction.

In another embodiment, for example, the printing direction conflict resolution criteria is a default selection based on empirical data, and wherein the default selection is one of a plurality of default selections associated with a corresponding plurality of printing modes. For example, if the selected printing mode is "draft", then the default selection may be the printing direction associated with the target test patch associated with monochrome inkjet printhead 76. However, if a printing mode is selected that uses a high quantity of color ink, e.g., a "photo" mode, then the default selection may be the printing direction associated with the target test patch associated with a predominant ink color, e.g., that produced with cyan inkjet printhead 72-1, and designated as the preferred print direction.

After the printing direction conflict resolution criteria has been applied, the method proceeds to step S214.

At step S214, the preferred printing direction is selected as an initial print direction for a first printing pass in printing on a print media sheet so as to reduce the horizontal banding produced by adjacent or overlapping print swaths printed during multiple printing passes in generating the printed image. Controller 18 executes program instructions to select the preferred printing direction, and the preferred printing direction may be stored in memory circuit 26 for future use by inkjet print engine 22 during printing operations.

Figure 9A:
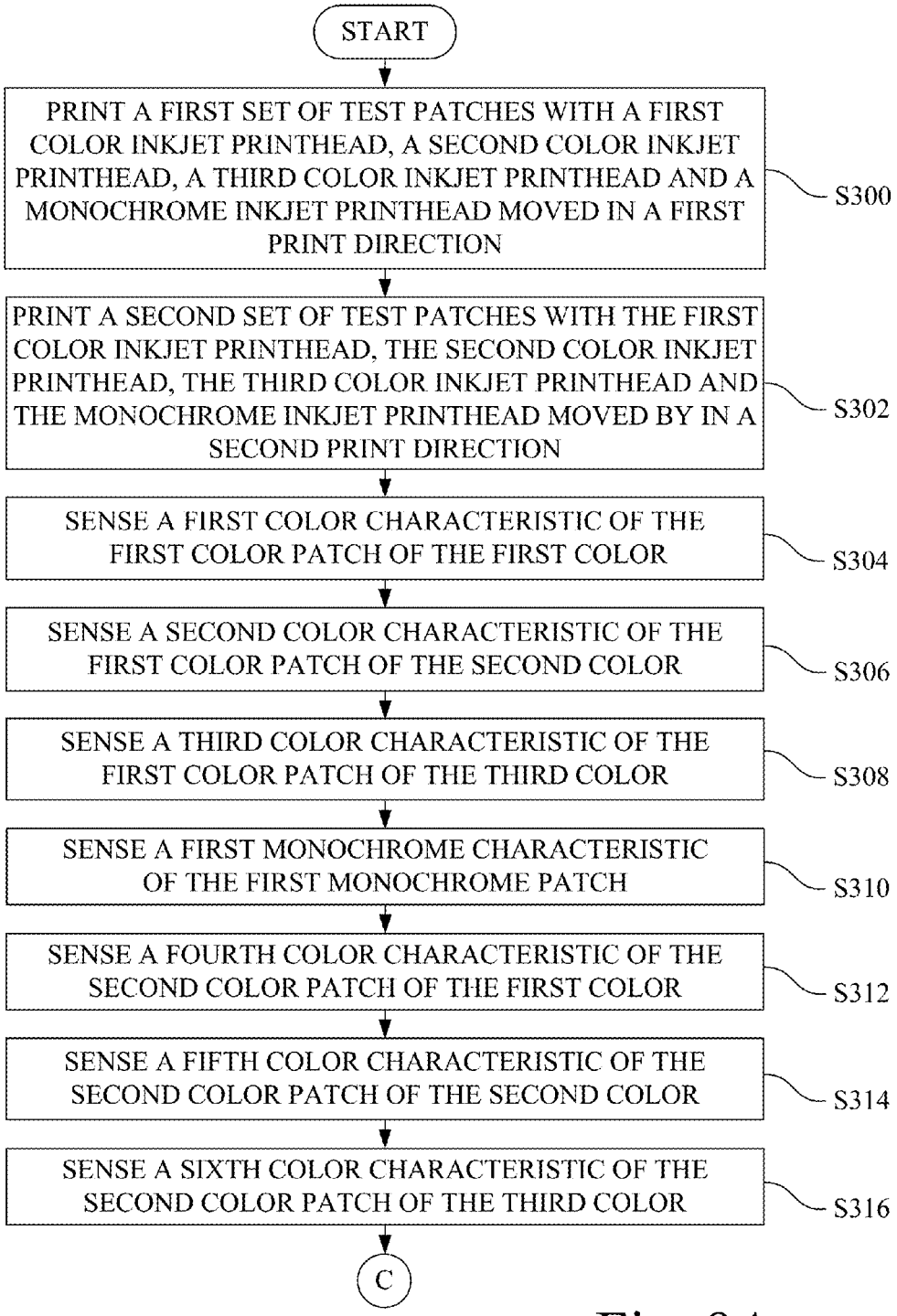
FIGS. 9A and 9B form a flowchart of another method for reducing horizontal banding in a printed image printed with the inkjet print engine of FIGS. 1-3.
Figure 9B:
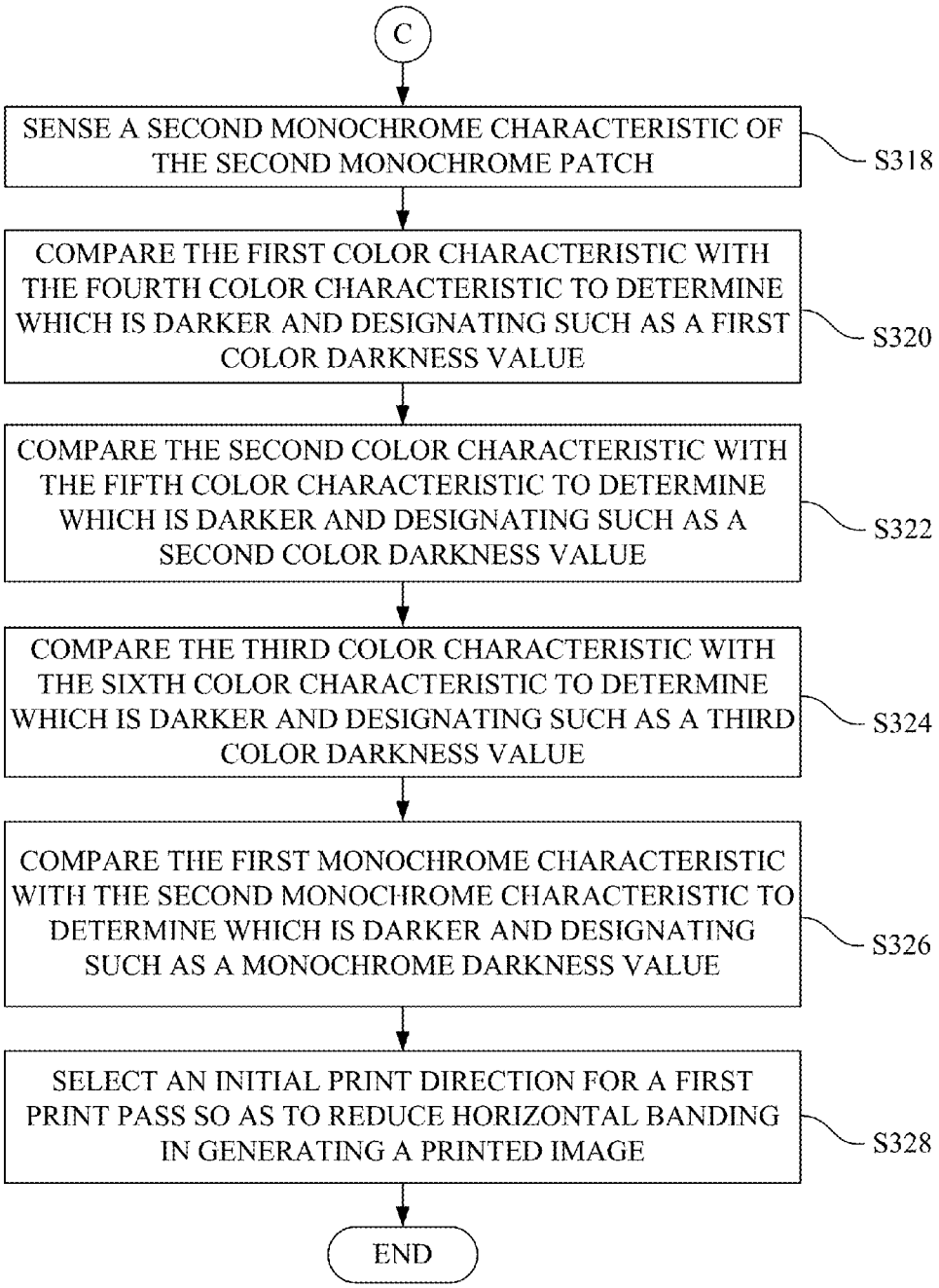

FIGS. 9A and 9B are directed to a variation of the method of FIGS. 7A, 7B, and also is directed to a method for reducing horizontal banding in a printed image printed with inkjet print engine 22, wherein the printed image is generated from multiple interleaved printing passes of the inkjet printheads 72-1, 72-2, 72-3 and 76. The method of FIGS. 9A and 9B may be implemented, in whole or in part, in the form of program instructions executed by controller 18.

At step S300, with reference to FIG. 8, a first set of test patches 120-1 is printed, with a first (e.g., cyan) color inkjet printhead 72-1, a second (e.g., magenta) color inkjet printhead 72-2, a third (e.g., yellow) color inkjet printhead 72-3, and a monochrome (e.g., black) inkjet printhead 76, respectively, being moved by the printhead carrier 62 in left-to-right print direction 94. In the present example, the first set of test patches 120-1 include a first color test patch 110-1 of cyan, a first color test patch 112-1 of magenta, a first color test patch 114-1 of yellow, and a first monochrome test patch 116-1 of black, respectively corresponding to the cyan color inkjet printhead 72-1, the magenta color inkjet printhead 72-2, the yellow color inkjet printhead 72-3 and the monochrome inkjet printhead 76.

At step S302, with reference to FIG. 8, a second set of test patches 120-2 is printed, with the first (e.g., cyan) color inkjet printhead 72-1, the second (e.g., magenta) color inkjet printhead 72-2, the third (e.g., yellow) color inkjet printhead 72-3, and the monochrome (e.g., black) inkjet printhead 76, respectively, being moved by the printhead carrier 62 in right-to-left print direction 96. In the present example, the second set of test patches 120-2 include a second color test patch 110-2 of cyan, a second color test patch 112-2 of magenta, a second color test patch 114-2 of the yellow, and a second monochrome test patch 116-2 of black, respectively corresponding to the cyan color inkjet printhead 72-1, the magenta color inkjet printhead 72-2, the yellow color inkjet printhead 72-3 and the monochrome inkjet printhead 76.

At step S304, a first color characteristic of first color test patch 110-1 of cyan is sensed by an optical sensor, such as optical sensor 68.

At step S306, a second color characteristic of the first color test patch 112-1 of magenta is sensed by optical sensor 68.

At step S308, a third color characteristic of the first color test patch 114-1 of yellow is sensed by optical sensor 68.

At step S310, a first monochrome characteristic of first monochrome test patch 116-1 of black is sensed by an optical sensor 68.

At step S312, a fourth color characteristic of the second color test patch 110-2 of cyan is sensed by optical sensor 68.

At step S314, a fifth color characteristic of the second color test patch 112-2 of magenta is sensed by optical sensor 68.

At step S316, a sixth color characteristic of the second color test patch 114-2 of yellow is sensed by optical sensor 68.

At step S318, a second monochrome characteristic of second monochrome test patch 116-2 of black is sensed by an optical sensor 68.

At step S320, the first color characteristic is compared with the fourth color characteristic to determine which of first color test patch 110-1 of the cyan and the second color test patch 110-2 of cyan is darker and designating such as a first color darkness value. Where the patch color is cyan, the sensing at steps S304 and S312 of the first color characteristic and the fourth color characteristic may be performed using a red light channel of a multi-channel optical sensor 68, and the first color darkness value may be a reflectance value, or alternatively, may include a chromatic component a*, b* in CIELAB color space. Controller 18 executes program instructions to perform the comparing and designating.

At step S322, the second color characteristic is compared with the fifth color characteristic to determine which of first color test patch 112-1 of magenta and the second color test patch 112-2 of magenta is darker and designating such as a second color darkness value. Where the color is magenta, the sensing at steps S306 and S314 of the second color characteristic and the fifth color characteristic is performed using a green light channel of multi-channel optical sensor 68, and the second color darkness value may be a reflectance value, or alternatively, may include a chromatic component a*, b* in CIELAB color space. Controller 18 executes program instructions to perform the comparing and designating.

At step S324, the third color characteristic is compared with the sixth color characteristic to determine which of first color test patch 114-1 of yellow and the second color test patch 114-2 of yellow is darker and designating such as a third color darkness value. Where the third color is yellow, the sensing at steps S308 and S316 of the third color characteristic and the sixth color characteristic is performed using the blue channel of multi-channel sensor 68, and the third color darkness value may be a reflectance value, or alternatively, may include a chromatic component a*, b* in CIELAB color space. Controller 18 executes program instructions to perform the comparing and designating.

At step S326, the first monochrome characteristic is compared with the second monochrome characteristic to determine which of the first monochrome test patch 116-1 and the second monochrome test patch 116-2 is darker, and designating such as a monochrome darkness value. The monochrome darkness value may be in the form of a reflectance value, or alternatively, a luminance L* value in CIELAB color space. Controller 18 executes program instructions to perform the comparing and designating.

At step S328, based on the comparing of steps S320, S322, S324 and S326, an initial print direction of at least one of the cyan color inkjet printhead 72-1, the magenta color inkjet printhead 72-2, the yellow inkjet printhead 72-3, and the monochrome inkjet printhead 76 is selected for a first print pass so as to reduce horizontal banding produced by adjacent or overlapping print swaths printed during multiple horizontal printing passes of at least one of the cyan color inkjet printhead 72-1, the magenta color inkjet printhead 72-2, the third color inkjet printhead 72-3 and the monochrome inkjet printhead 76 in generating a printed image. Controller 18 executes program instructions to perform the selection, and the initial print direction may be stored in memory circuit 26 for future use by inkjet print engine 22 during printing operations.

In one embodiment, the selecting at step S328 selects as the initial print direction for monochrome inkjet printhead 76 the left-to-right print direction 94 if the first monochrome characteristic is greater than the second monochrome characteristic, and selects as the initial print direction the second print direction if the second monochrome characteristic is greater than the first monochrome characteristic.

In another embodiment, the selecting at step S328 includes determining which of the first color darkness value, the second color darkness value, and the third color darkness value is darker, and then selecting as the initial print direction the one print direction of the left-to-right print direction 94 and the right-to-left print direction 96 that is associated with the darker of the first color darkness value, the second color darkness value, and the third color darkness value.

In another embodiment, the selecting at step S326 includes determining which of the first color darkness value, the second color darkness value, and the third color darkness value is more chromatic, and the selecting as the initial print direction the one print direction of the left-to-right print direction 94 and the right-to-left print direction 96 that is associated with the more chromatic (e.g., a*, b* in the CIELAB color space) of the first color darkness value, the second color darkness value, and the third color darkness value.

In another embodiment, a predominant ink color for printing an image may be determined. Where the predominant color is cyan, the first color test patch 110-1 of cyan and the second color test patch 110-2 of cyan are populated by a cyan inkjet printhead 72-1 at a horizontal resolution (e.g., 300) and a vertical resolution (e.g., 1200) defining a plurality of ink dot locations. The cyan inkjet printhead 72-1 is controlled by controller 18 to deliver an ink drop at each of the plurality of ink dot locations, wherein the ink drop includes a mother ink drop and a satellite ink drop. In this case, the selecting at step S328 selects as the initial print direction one print direction of the left-to-right print direction 94 and the right-to-left print direction 96 that produces the least amount of overlap between the mother ink drop and the satellite ink drop of the cyan color.

Alternatively, for example, if the predominant ink color for printing an image is monochrome, e.g., black, then the first black patch and the second black patch are populated by a black inkjet printhead 76 at a horizontal resolution (e.g., 300 dpi) and a vertical resolution (e.g., 1200 dpi) defining a plurality of ink dot locations. Black inkjet printhead 76 is controlled by controller 18 to deliver an ink drop at each of the plurality of ink dot locations, wherein the ink drop includes a mother ink drop and a satellite ink drop. In this case, the selecting at step S328 selects as the initial print direction one print direction of the left-to-right print direction 94 and the second print direction that produces the least amount of overlap between the mother ink drop and the satellite ink drop of black.

While this invention has been described with respect to at least one embodiment, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for reducing horizontal banding in a printed image printed with an inkjet print engine having a printhead carrier carrying at least one inkjet printhead, comprising:

printing on a print media sheet a first test patch with a first inkjet printhead being moved by the printhead carrier in a first print direction;

printing on a print media sheet a second test patch with the first inkjet printhead being moved by the printhead carrier in a second print direction, the second print direction being opposite to the first print direction;

determining a first characteristic of the first test patch;

determining a second characteristic of the second test patch;

comparing the first characteristic of the first test patch with the second characteristic of the second test patch;

selecting, based on the comparing, an initial print direction of the first inkjet printhead for a first printing pass that reduces horizontal banding in generating the printed image and wherein the first test patch and the second test patch are populated by the first inkjet printhead at a horizontal resolution and a vertical resolution defining a plurality of ink dot locations, the first inkjet printhead being controlled to deliver an ink drop at each of the plurality of ink dot locations, and wherein the ink drop includes a mother ink drop and a satellite ink drop, and wherein the act of selecting selects as the initial print direction one print direction of the first print direction and the second print direction that produces the least amount of overlap between the mother ink drop and the satellite ink drop.

2. The method of claim 1, wherein each of the first characteristic and the second characteristic is reflectance, and the act of selecting comprises selecting as the initial print direction the first print direction if the reflectance of the first test patch is less than the reflectance of the second test patch, and selecting as the initial print direction the second print direction if the reflectance of the second test patch is less than the reflectance of the first test patch.

3. The method of claim 1, wherein the first inkjet printhead is a black inkjet printhead, each of the first test patch and second test patch is formed by black ink, and each of the first characteristic and the second characteristic is luminance, and wherein the act of selecting comprises selecting as the initial print direction the first print direction if the first luminance L* value is less than the second luminance L* value, and selecting as the initial print direction the second print direction if the second luminance L* value is less than the first luminance L* value.

4. The method of claim 1, wherein the first inkjet printhead is a color inkjet printhead, each of the first test patch and the second test patch is formed by a color ink, and each of the first characteristic and the second characteristic is a chromatic value, and wherein the act of selecting comprises selecting as the initial print direction the first print direction if the first chromatic value is greater than the second chromatic value, and selecting as the initial print direction the second print direction if the second chromatic value is greater than the first chromatic value.

5. The method of claim 1, wherein:

the first characteristic of the first test patch and the second characteristic of the second test patch are sensed by a scanner or sensor assembly having a multi-channel optical sensor having at least one light emitter having red, green and blue light components and having red, green, and blue light detectors;

the first inkjet printhead is a color inkjet printhead for printing a color ink that is one of cyan, magenta, and yellow;

the multi-channel optical sensor has a red light channel used to generate sensing data for a cyan test patch, the multi-channel optical sensor has a green light channel used to generate sensing data for a magenta test patch, and the multi-channel optical sensor has a blue light channel used to generate sensing data for a yellow test patch; and the sensing data associated with the test patch color of the first test patch and the second test patch is compared in the act of comparing.

6. The method of claim 1, wherein each of the first characteristic and the second characteristic is one of a reflectance characteristic, a luminance characteristic, and a chromatic characteristic.

7. A method for reducing horizontal banding in a printed image printed with an inkjet print engine having a printhead carrier carrying at least one color inkjet printhead and at least one monochrome inkjet printhead, wherein the printed image is generated from multiple interleaved printing passes of at least one color inkjet printhead and at least one monochrome inkjet printhead, the method comprising:

printing on a print media sheet with each color inkjet printhead and each monochrome printhead a respective pair of test patches, wherein a first test patch is printed while moving the printhead carrier in a first print direction and a second test patch is printed while moving the printhead carrier in a second print direction, the second print direction being opposite to the first print direction;

scanning each respective pair of test patches with a sensor to generate sensing data corresponding to the first test patch and the second test patch for each color inkjet printhead and each monochrome printhead;

determining from the sensing data, for each color inkjet printhead and each monochrome printhead, which of the first test patch and the second test patch has the most satellite ink drops offset from mother drops and designating such as a respective target test patch;

identifying, for each color inkjet printhead and each monochrome printhead, a printing direction used in generating the respective target test patch, the printing direction being one of the first print direction and the second print direction and being designated as a respective target print direction;

if the respective target print direction of each color inkjet printhead and each monochrome printhead is not in the same direction, then applying a printing direction conflict resolution criteria to select a preferred printing direction to be applied to each color inkjet printhead and each monochrome printhead; and selecting the preferred printing direction as an initial print direction for a first printing pass in printing on a print media sheet so as to reduce horizontal banding in generating the printed image.

8. The method of claim 7, wherein the printing direction conflict resolution criteria comprises comparing each respective target test patch associated with each color inkjet printhead and each monochrome printhead to determine which respective target test patch has the most satellite ink drops offset from mother drops, to select the preferred printing direction.

9. The method of claim 7, wherein the printing direction conflict resolution criteria is a default selection based on empirical data, and wherein the default selection is one of a plurality of default selections associated with a corresponding plurality of printing modes.

10. The method of claim 7, wherein the sensing data is generated by a multi-channel optical sensor having at least one light emitter having red, green and blue light components and having red, green, and blue light detectors.

11. The method of claim 10, wherein the multi-channel optical sensor has a red light channel used to generate the sensing data for a cyan test patch, the multi-channel optical sensor has a green light channel used to generate the sensing data for a magenta test patch, and the multi-channel optical sensor has a blue light channel used to generate the sensing data for a yellow test patch.

12. A method for reducing horizontal banding in a printed image printed with an inkjet print engine having a printhead carrier carrying a plurality of inkjet printheads, comprising:

printing on a print media sheet a first set of test patches with a first color inkjet printhead, a second color inkjet printhead, a third color inkjet printhead and a monochrome inkjet printhead being moved by the printhead carrier in a first print direction, the first set of test patches including a first color patch of a first color, a first color patch of a second color, a first color patch of a third color, and a first monochrome patch respectively corresponding to the first color inkjet printhead, the second color inkjet printhead, the third color inkjet printhead and the monochrome inkjet printhead;

printing on a print media sheet a second set of test patches with the first color inkjet printhead, the second color inkjet printhead, the third color inkjet printhead and the monochrome inkjet printhead being moved by the printhead carrier in a second print direction opposite the first print direction, the second set of test patches including a second color patch of the first color, a second color patch of the second color, a second color patch of the third color, and a second monochrome patch respectively corresponding to the first color inkjet printhead, the second color inkjet printhead, the third color inkjet printhead and the monochrome inkjet printhead;

sensing a first color characteristic of the first color patch of the first color;

sensing a second color characteristic of the first color patch of the second color;

sensing a third color characteristic of the first color patch of the third color;

sensing a first monochrome characteristic of the first monochrome patch;

sensing a fourth color characteristic of the second color patch of the first color;

sensing a fifth color characteristic of the second color patch of the second color;

sensing a sixth color characteristic of the second color patch of the third color;

sensing a second monochrome characteristic of the second monochrome patch;

comparing the first color characteristic with the fourth color characteristic to determine which of first color patch of the first color and the second color patch of the first color is darker and designating such as a first color darkness value;

comparing the second color characteristic with the fifth color characteristic to determine which of first color patch of the second color and the second color patch of the second color is darker and designating such as a second color darkness value;

comparing the third color characteristic with the sixth color characteristic to determine which of first color patch of the third color and the second color patch of the third color is darker and designating such as a third color darkness value;

comparing the first monochrome characteristic with the second monochrome characteristic to determine which of the first monochrome patch and the second monochrome patch is darker and designating such as a monochrome darkness value; and selecting, based on the comparing, an initial print direction of at least one of the first color inkjet printhead, the second color inkjet printhead, the third color inkjet printhead and the monochrome inkjet printhead for a first print pass so as to reduce horizontal banding in generating a printed image.

13. The method of claim 12, wherein the act of selecting comprises selecting as the initial print direction for the monochrome printhead the first print direction if the first monochrome characteristic is greater than the second monochrome characteristic, and selecting as the initial print direction the second print direction if the second monochrome characteristic is greater than the first monochrome characteristic.

14. The method of claim 12, further comprising:

determining which of the first color darkness value, the second color darkness value, and the third color darkness value is darker; and selecting as the initial print direction the one print direction of the first print direction and the second print direction associated with the darker of the first color darkness value, the second color darkness value, and the third color darkness value.

15. The method of claim 12, further comprising:

determining, which of the first color darkness value, the second color darkness value, and the third color darkness value is more chromatic; and selecting as the initial print direction the one print direction of the first print direction and the second print direction associated with the more chromatic of the first color darkness value, the second color darkness value, and the third color darkness value.

16. The method of claim 12, wherein:

the first color is cyan, and the sensing of the first color characteristic and the fourth color characteristic is using a red light channel of a multi-channel sensor, and wherein the first color darkness value includes a chromatic component;

the second color is magenta, and the sensing of the second color characteristic and the fifth color characteristic is performed using a green light channel of a multi-channel sensor, and wherein the second color darkness value includes a chromatic component; and the third color is yellow, and the sensing of the third color characteristic and the sixth color characteristic is performed using the blue channel of a multi-channel sensor, and wherein the third color darkness value includes a chromatic component.

17. The method of claim 16, further comprising:

determining, which of the first color darkness value, the second color darkness value, and the third color darkness value is more chromatic; and selecting as the initial print direction the one print direction of the first print direction and the second print direction associated with the more chromatic of the first color darkness value, the second color darkness value, and the third color darkness value.

18. The method of claim 12, wherein the first color is cyan, and the first color patch of cyan and the second color patch of cyan are populated by a cyan inkjet printhead at a horizontal resolution and a vertical resolution defining a plurality of ink dot locations, the cyan inkjet printhead being controlled to deliver an ink drop at each of the plurality of ink dot locations, and wherein the ink drop includes a mother ink drop and a satellite ink drop, and wherein the act of selecting selects as the initial print direction one print direction of the first print direction and the second print direction that produces the least amount of overlap between the mother ink drop and the satellite ink drop of the cyan color.

19. The method of claim 12, wherein monochrome is black, and the first black patch and the second black patch are populated by a black inkjet printhead at a horizontal resolution and a vertical resolution defining a plurality of ink dot locations, the black inkjet printhead being controlled to deliver an ink drop at each of the plurality of ink dot locations, and wherein the ink drop includes a mother ink drop and a satellite ink drop, and wherein the act of selecting selects as the initial print direction one print direction of the first print direction and the second print direction that produces the least amount of overlap between the mother ink drop and the satellite ink drop of black.

* * * * *